US011667097B2

(12) United States Patent
Cordova

(10) Patent No.: US 11,667,097 B2
(45) Date of Patent: Jun. 6, 2023

(54) METHOD AND SYSTEM FOR PROCESSING BLANKS FOR FORMING CONSTRUCTS

(71) Applicant: Graphic Packaging International, LLC, Atlanta, GA (US)

(72) Inventor: Mark Cordova, Westminster, CO (US)

(73) Assignee: Graphic Packaging International, LLC, Atlanta, GA (US)

( * ) Notice: Subject to any disclaimer, the term of this patent is extended or adjusted under 35 U.S.C. 154(b) by 551 days.

(21) Appl. No.: 16/674,371

(22) Filed: Nov. 5, 2019

(65) Prior Publication Data

US 2020/0139658 A1 May 7, 2020

Related U.S. Application Data

(60) Provisional application No. 62/756,242, filed on Nov. 6, 2018.

(51) Int. Cl.

| | |
|---|---|
| ***B31B 50/58*** | (2017.01) |
| ***B31F 1/00*** | (2006.01) |
| ***B31B 50/04*** | (2017.01) |
| ***B31B 50/52*** | (2017.01) |

(52) U.S. Cl.

CPC ..... *B31B 50/58* (2017.08); *B31B 50/042* (2017.08); *B31B 50/52* (2017.08); *B31F 1/0009* (2013.01); *B31F 1/0035* (2013.01)

(58) Field of Classification Search

CPC ..... B31B 50/58; B31B 17/02; B31F 1/0003; B31F 1/0009; B31F 1/0035; B31F 1/0054

USPC ..... 53/287, 38, 41

See application file for complete search history.

(56) References Cited

U.S. PATENT DOCUMENTS

| | | | |
|---|---|---|---|
| 1,405,139 A | 1/1922 | La Bombard et al. | |
| 3,575,409 A | 4/1971 | Calvert | |
| 3,951,049 A * | 4/1976 | Brackmann | B65B 7/2807 53/589 |
| 3,981,494 A | 9/1976 | Prestegaard | |
| 4,034,658 A | 7/1977 | Sherman | |
| 4,244,281 A | 1/1981 | Kauffman et al. | |

(Continued)

FOREIGN PATENT DOCUMENTS

| | | |
|---|---|---|
| CN | 2317075 Y | 5/1999 |
| DE | 379 470 C | 8/1923 |

(Continued)

OTHER PUBLICATIONS

International Search Report and Written Opinion for PCT/US2019/059776 dated Apr. 10, 2020.

(Continued)

*Primary Examiner* — Andrew M Tecco
*Assistant Examiner* — Jacob A Smith
(74) *Attorney, Agent, or Firm* — Womble Bond Dickinson (US) LLP

(57) ABSTRACT

A method of processing a blank for forming a construct includes obtaining the blank, the blank including a flexible material and is for being formed into a construct. The method also includes moving the blank in a downstream direction on a first guide and a second guide, and pressing an interior region of the blank with a shaping apparatus in a direction transverse to the machine direction as the blank moves in the downstream direction and as a peripheral region of the blank is engaged by at least one shaping bracket.

44 Claims, 9 Drawing Sheets

(56) References Cited

U.S. PATENT DOCUMENTS

| | | | |
|---|---|---|---|
| 4,331,434 | A | 5/1982 | Buschor |
| 4,582,315 | A | 4/1986 | Scarpa et al. |
| 4,802,664 | A | 2/1989 | Larsen |
| 4,881,934 | A | 11/1989 | Harston et al. |
| 4,986,522 | A | 1/1991 | Paulson |
| 5,019,029 | A | 5/1991 | Calvert |
| 5,102,385 | A | 4/1992 | Calvert |
| 5,102,485 | A | 4/1992 | Keeler et al. |
| 5,176,612 | A | 1/1993 | Calvert et al. |
| 5,254,071 | A | 10/1993 | Laroche |
| 5,282,528 | A | 2/1994 | Hudson |
| 5,542,349 | A | 8/1996 | Goesslinghoff |
| 5,632,368 | A | 5/1997 | Moncrief |
| 5,653,671 | A | 8/1997 | Reuteler |
| 5,657,610 | A | 8/1997 | Dietrich et al. |
| 5,662,577 | A | 9/1997 | Reuteler |
| 5,997,458 | A | 12/1999 | Guttinger et al. |
| 6,050,063 | A | 4/2000 | Ford et al. |
| 6,073,423 | A | 6/2000 | House |
| 6,146,028 | A | 11/2000 | Preszler |
| 6,213,286 | B1 | 4/2001 | Hunter et al. |
| 6,311,457 | B1 | 11/2001 | May et al. |
| 6,490,843 | B1 | 12/2002 | May |
| 6,497,084 | B1 | 12/2002 | Janen |
| 6,509,052 | B1 | 1/2003 | Benham et al. |
| 6,550,608 | B1 | 4/2003 | Brown et al. |
| 6,993,889 | B2 | 2/2006 | Ford et al. |
| 7,070,551 | B2 | 7/2006 | Lasson |
| 7,461,838 | B2 | 12/2008 | Hendricks et al. |
| 7,695,421 | B2 | 4/2010 | Ford |
| 8,870,519 | B2 | 10/2014 | Karst |
| 10,562,675 | B2 | 2/2020 | Walsh |
| 2002/0041067 | A1 | 4/2002 | Muller |
| 2006/0037290 | A1 | 2/2006 | Smith |
| 2006/0197272 | A1 | 9/2006 | Hendricks et al. |
| 2007/0042072 | A1 | 2/2007 | Johns et al. |
| 2007/0063416 | A1 | 3/2007 | Kisch |
| 2007/0085260 | A1 | 4/2007 | Hendricks et al. |
| 2007/0257416 | A1 | 11/2007 | Ford |
| 2008/0227612 | A1 | 9/2008 | Harston |
| 2009/0087296 | A1 | 4/2009 | May et al. |

FOREIGN PATENT DOCUMENTS

| | | | | | |
|---|---|---|---|---|---|
| DE | 10 2007 057114 | A1 | | 5/2008 | |
| DE | 10 2016 203204 | A1 | | 9/2016 | |
| GB | 1 355 270 | A | | 6/1974 | |
| JP | 08-000680 | U | | 4/1996 | |
| JP | H08680 | U | * | 4/1996 | ..... B05B 13/02 |
| KR | 10-2014-0002921 | A | | 1/2014 | |
| KR | 20140002921 | A | * | 1/2014 | ..... B21D 1/02 |
| KR | 10-1787026 | B1 | | 10/2017 | |

OTHER PUBLICATIONS

Supplementary European Search Report for EP 19 88 1094 dated Jul. 20, 2022.

* cited by examiner

METHOD AND SYSTEM FOR PROCESSING BLANKS FOR FORMING CONSTRUCTS

CROSS-REFERENCE TO RELATED APPLICATION

This application claims the benefit of U.S. Provisional Patent Application No. 62/756,242, filed on Nov. 6, 2018.

INCORPORATION BY REFERENCE

The disclosure of U.S. Provisional Patent Application No. 62/746,212, filed on Nov. 6, 2018, is hereby incorporated by reference for all purposes as if presented herein in its entirety.

BACKGROUND OF THE DISCLOSURE

The present disclosure generally relates to systems and methods of processing blanks for forming containers, trays, and/or other suitable constructs. More specifically, the present disclosure is directed to methods and systems for processing blanks and constructs formed therefrom.

SUMMARY OF THE DISCLOSURE

According to one aspect of the disclosure, a method of processing a blank for forming a construct comprises obtaining the blank, the blank comprising a flexible material and is for being formed into a construct. The method further comprises moving the blank in a downstream direction on a first guide and a second guide, and pressing an interior region of the blank with a shaping apparatus in a direction transverse to the downstream direction as the blank moves in the downstream direction and as a peripheral region of the blank is engaged by at least one shaping bracket.

According to another aspect of the disclosure, a system for processing a blank comprising a flexible material, the system comprising a first guide and a second guide at least partially supporting the blank and extending along a machine direction from an upstream end of the system to a downstream end of the system. The system further comprises a shaping apparatus coupled to a support, the shaping apparatus is movable along the support in a direction transverse to the machine direction to press an interior region of the blank, and a shaping bracket mounted to at least one of the first guide and the second guide for engaging a peripheral region of the blank as the blank is pressed by the shaping apparatus.

According to another aspect of the disclosure, a forming system for forming a construct from a blank comprising a flexible material, the forming system comprising a blank feeder for positioning the blank on a first guide and a second guide, the first guide and the second guide extending in a downstream direction. The forming system further comprises a shaping apparatus downstream from the blank feeder and coupled to a support, the shaping apparatus is movable along the support in a direction transverse to the downstream direction for pressing an interior region of the blank. The system further comprises a shaping bracket mounted to at least one of the first guide and the second guide for engaging a peripheral region of the blank as the blank is pressed by the shaping apparatus, and a press-forming apparatus positioned downstream from the shaping apparatus and being for forming the construct from the blank.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to a system and method of processing a blank or other construct for further processing and/or for forming containers, trays, or other constructs for holding products such as food products or other articles. For example, the containers could be used for heating or cooking food products. Containers according to the present disclosure can accommodate articles of any shape. The containers can comprise a bottom wall, a sidewall, and a flange and can be press-formed from a blank or other construct. The blank can generally be made from paperboard or other suitable stock material, which could be laminated (e.g., with a plastic film and/or microwave energy interactive material).

Figure 5A:
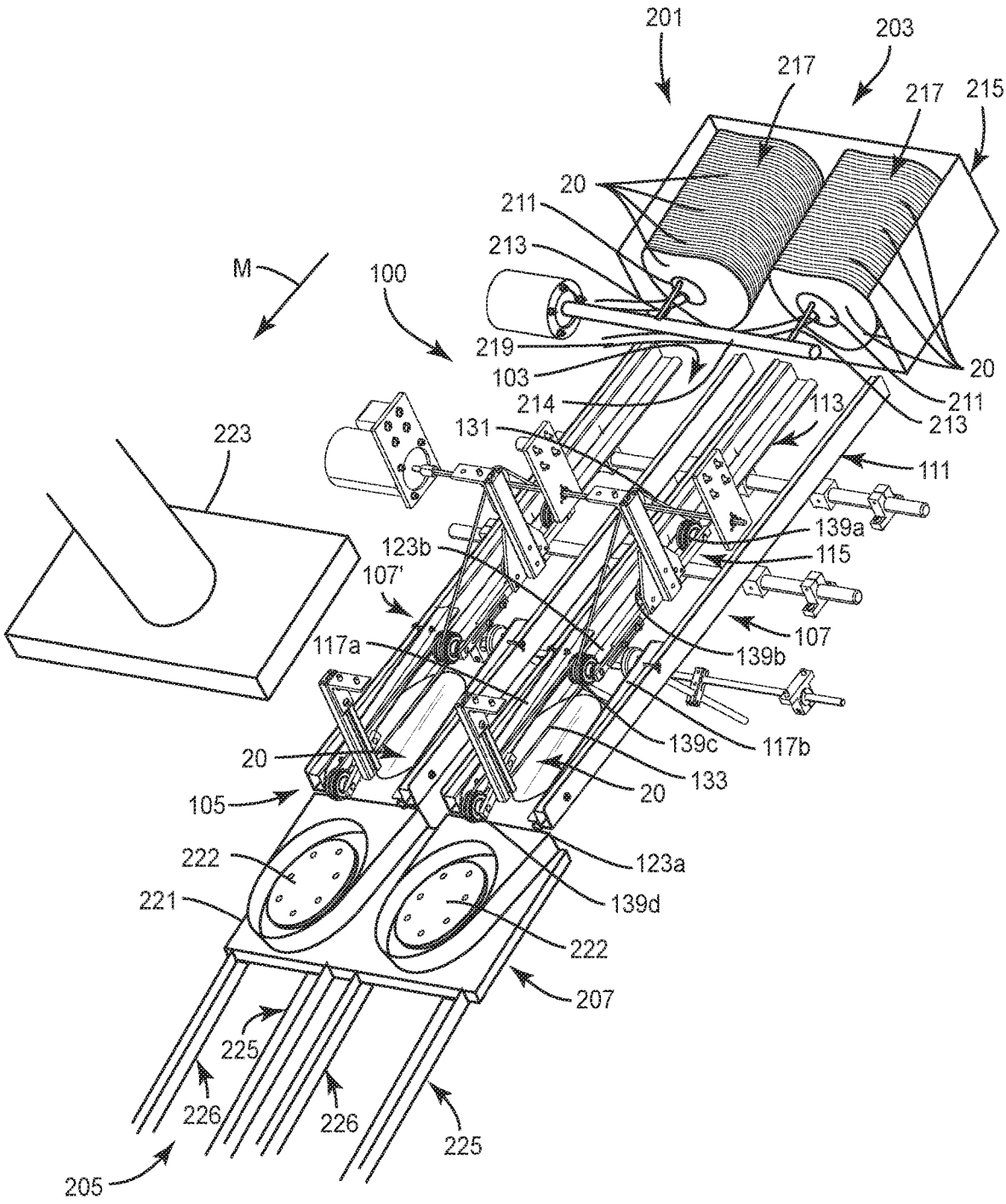
FIG. 5A is a perspective view of a forming system including the system of FIG. 1A according to an exemplary embodiment of the disclosure.
Figure 5B:
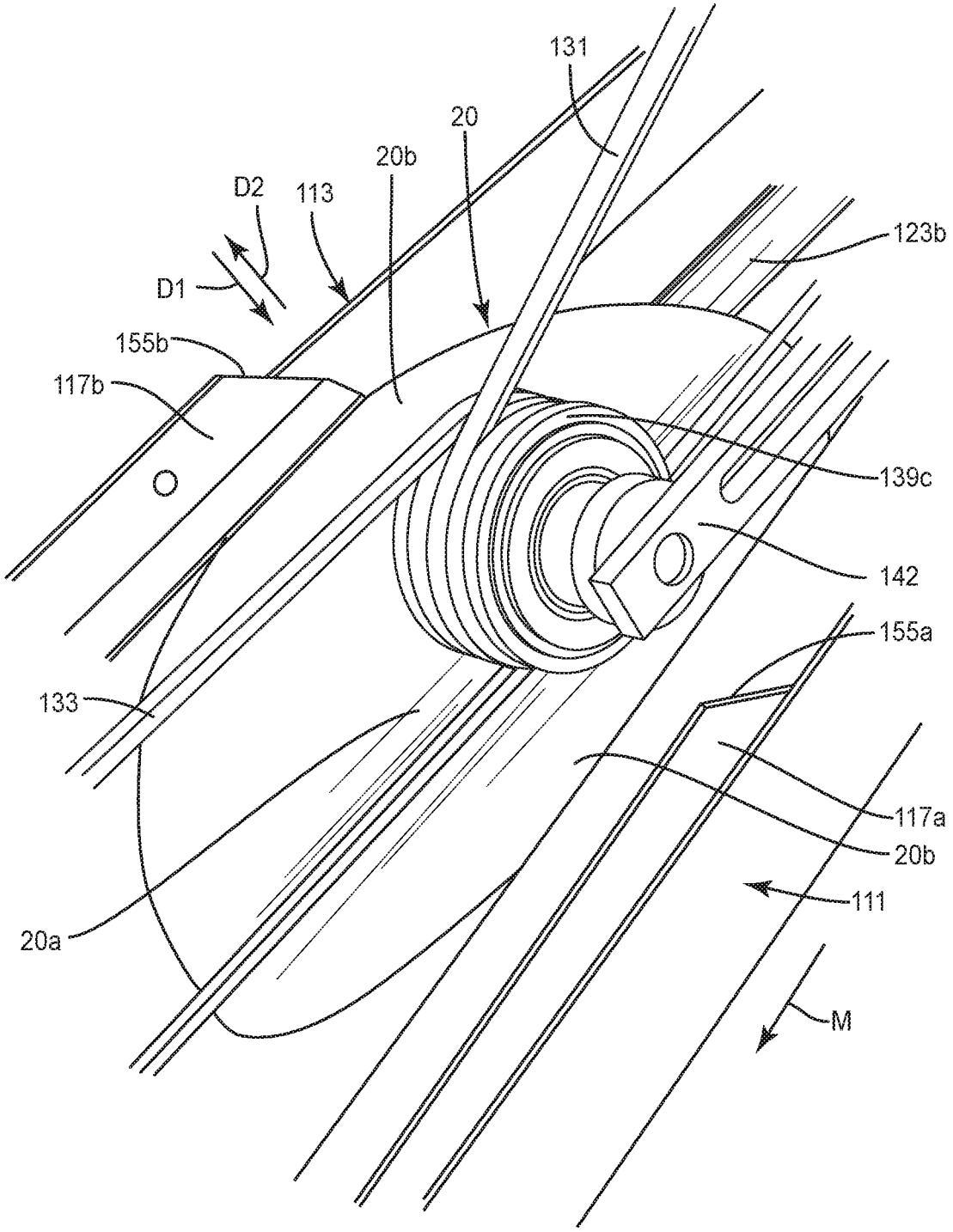
FIG. 5B is an enlarged perspective view of a portion of the forming system of FIG. 5A.
Figure 5C:
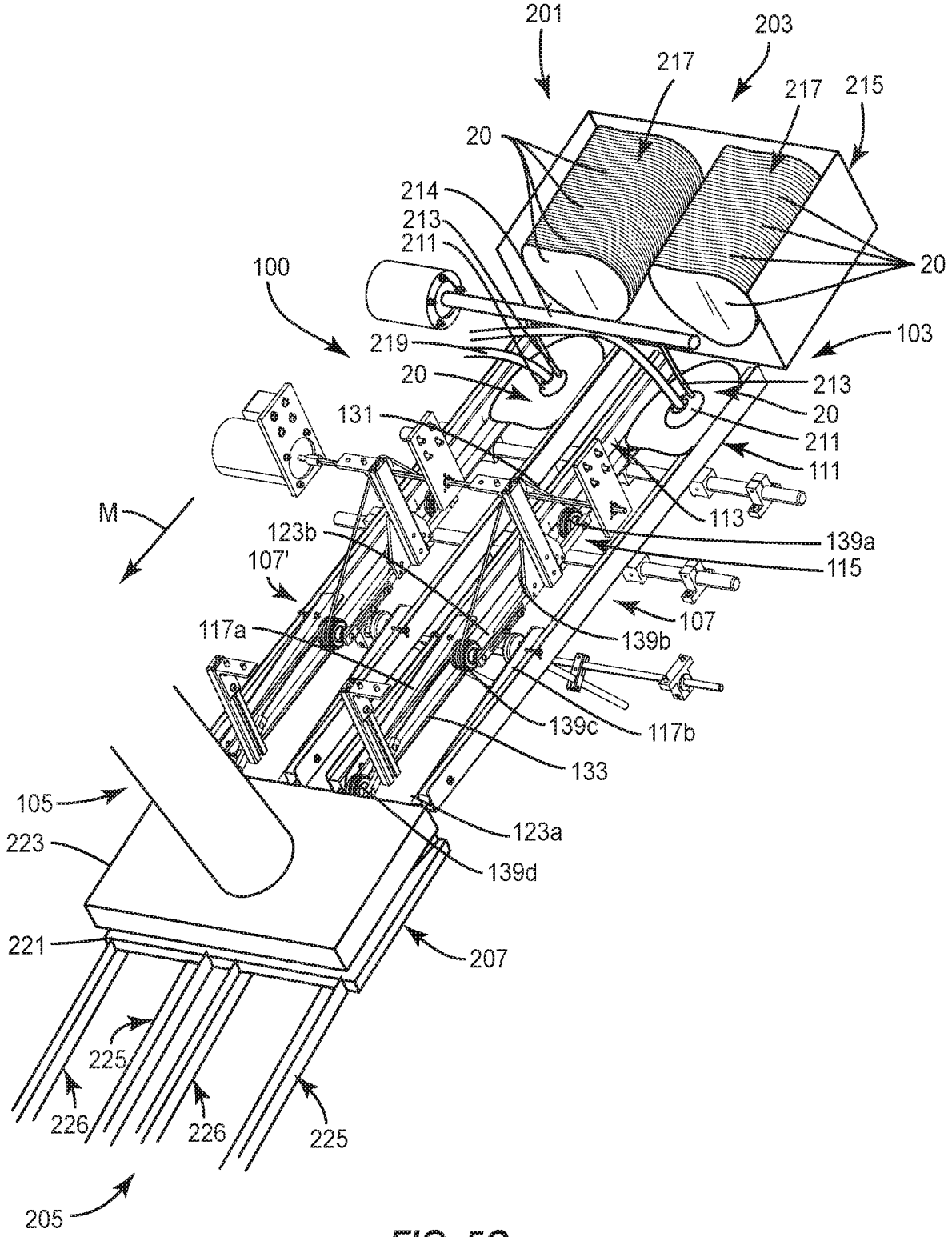
FIG. 5C is a first sequential perspective view of the forming system of FIG. 5A.
Figure 5D:
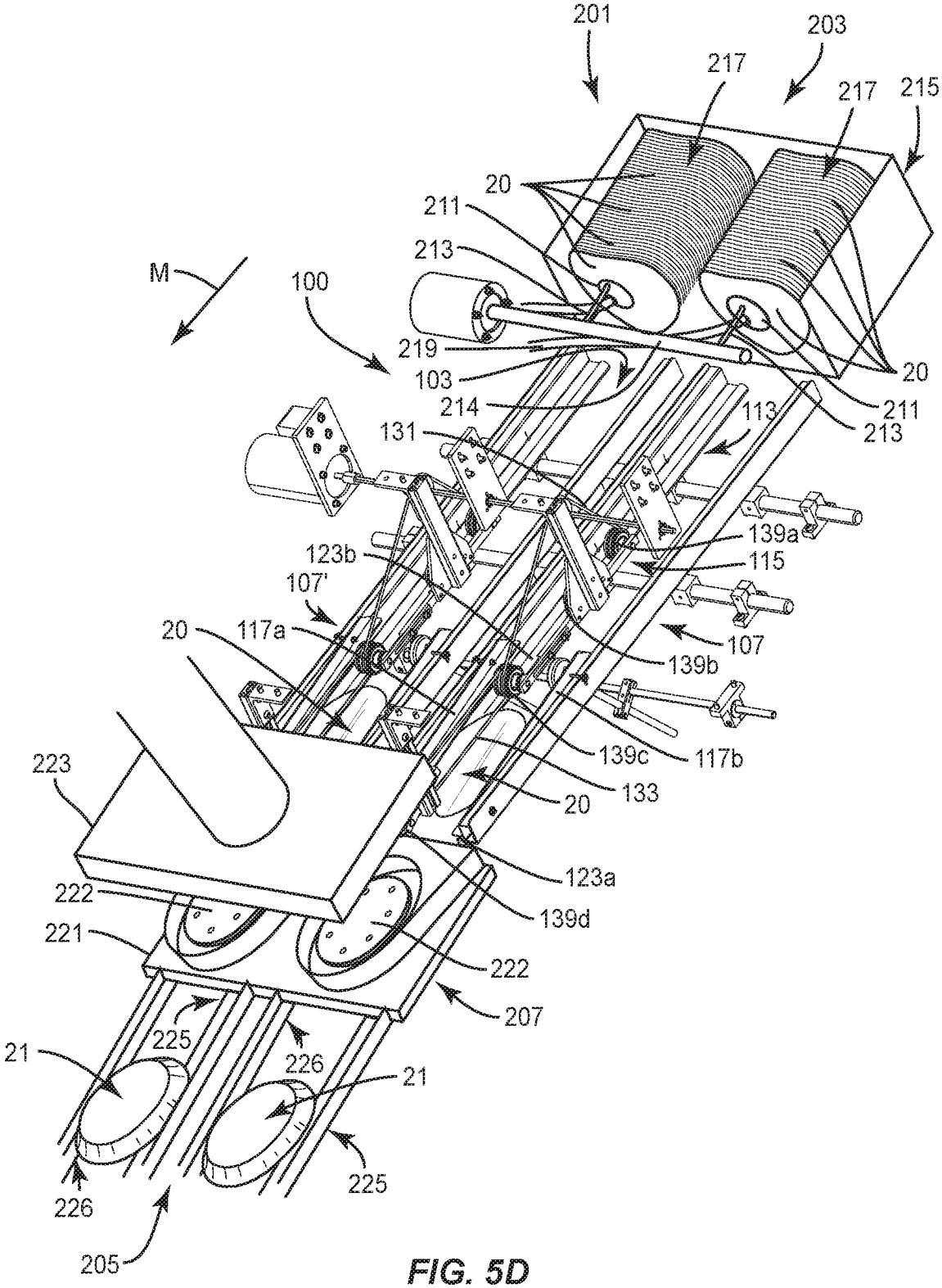
FIG. 5D is a second sequential perspective view of the forming system of FIG. 5A.

In one embodiment, exemplary containers or constructs (e.g., press-formed trays) 21 are shown in FIG. 5D. The trays 21 can be press-formed from blanks 20 (e.g., FIG. 1A) and can each include at least a bottom wall 23, a sidewall 25 extending from the bottom wall 23, and a flange 27 extending outwardly from an upper end of the sidewall 25. The blank 20 and the construct 21 can have any suitable shape (e.g., circular, oval, rectangular, annular, irregular, etc.). The blank 20 can be formed from a single ply of material, such as, but not limited to, paperboard, cardboard, paper, or a polymeric sheet, or, alternatively, the blank can be formed from a laminate that includes more than one layer. The blank 20 can have a thickness of the single ply or laminate that results in the blank 20 being flexible. In this regard, external forces applied to the blank 20 can cause the blank 20 to bend, curl, fold, warp, crease, etc.

In one embodiment, the blank 20 can include a microwave interactive layer such as is common in MicroRite® containers available from Graphic Packaging International of Atlanta, Ga. The microwave interactive layer can be commonly referred to as, or can have as one of its components, a susceptor, a foil, a microwave shield, or any other term or component that refers to a layer of material suitable for directing and/or shielding microwave energy and/or causing heating in a microwave oven.

In the illustrated embodiment, a pair of blanks 20 are illustrated as having similar configurations, e.g., generally elliptical members. It will be understood that that one or both of the blanks 20 can be differently configured, e.g., having a different shape/and or size, for example, generally circular or rounded rectangular, without departing from the disclosure. It will be further understood that the blanks 20 can be provided with a configuration that is similar or different from one another.

The trays 21 formed from the blanks 20 can have additional or alternative components, e.g., partitioned bottoms, injection-molded features, surface features, covering or lidding components, etc., without departing from the disclosure.

Figure 1A:
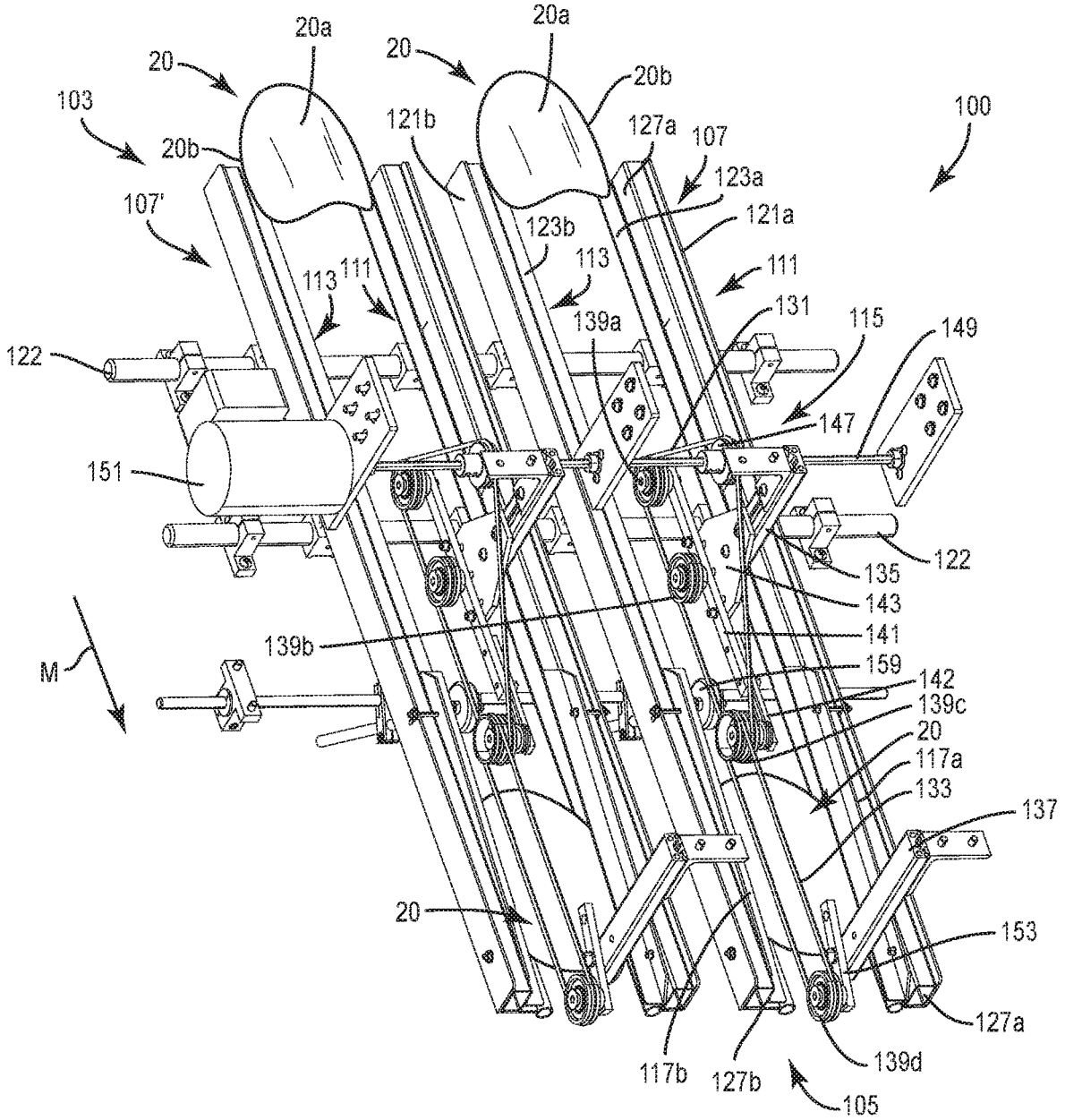
FIG. 1A is a perspective view of a system according to an exemplary embodiment of the disclosure.
Figure 1B:
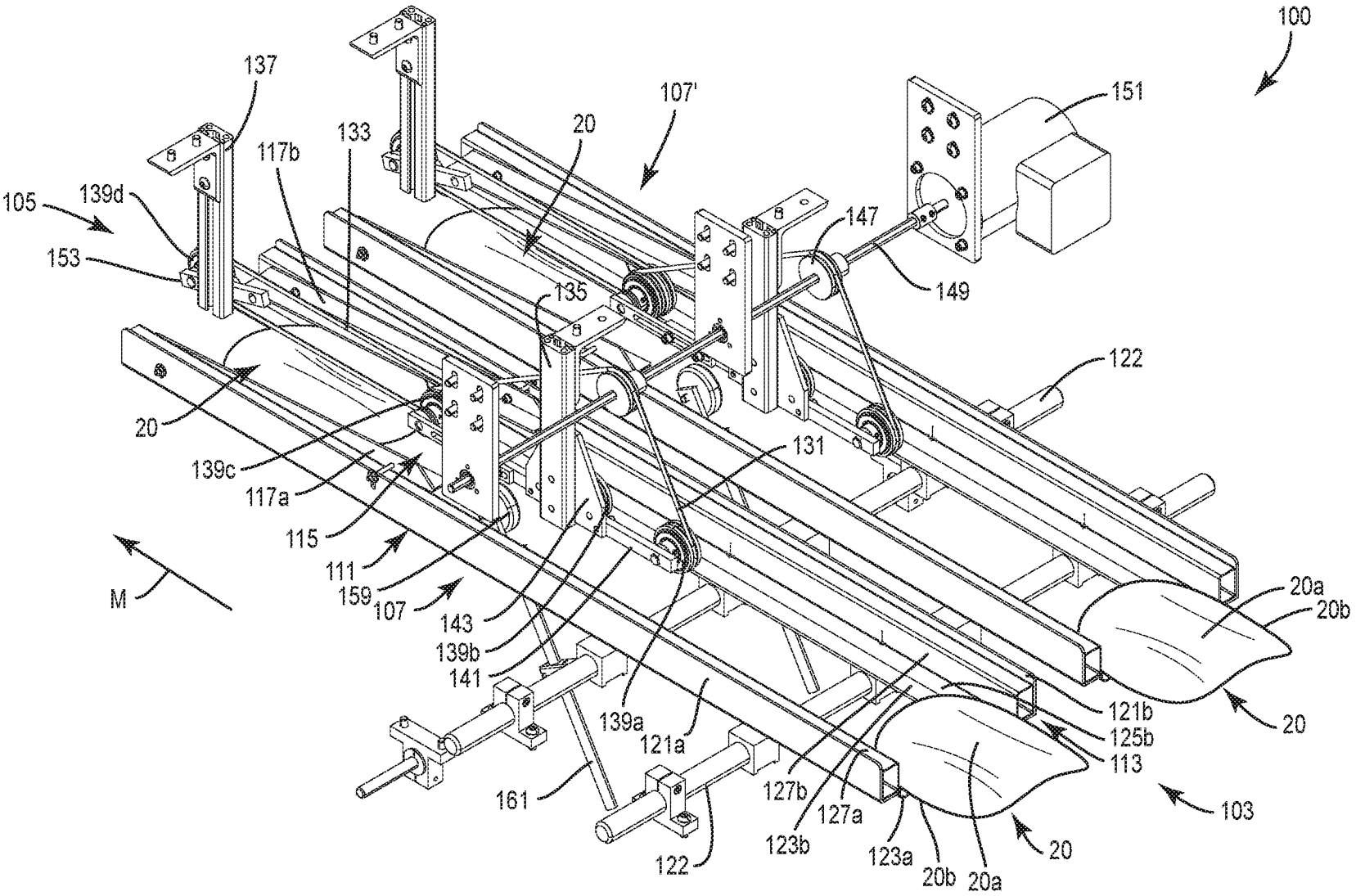
FIG. 1B is another perspective view of the system of FIG. 1A.

FIGS. 1A and 1B generally illustrate an example embodiment of a method and system 100 for de-curling or shaping or processing the blanks 20 or other constructs in accordance with the disclosure. In the illustrated embodiment, the system 100 engages a blank 20 in a first, curved or curled configuration as the blank 20 slides along the system 100 and presses a portion of the blank 20 to reconfigure the blank into a second, generally flat or generally planar configuration. In one embodiment, the system 100 can press the blank 20 in a direction opposite a curl bias or other deformation in the blank 20 to overcome or counteract such curl bias or deformation in the blank 20. As described herein, curl bias can be a tendency of the blank 20 to deform, e.g., bend, curl, warp, along one or more portions thereof. Such curl bias can arise as a property of the material that forms the blank 20, as a result of one or more manufacturing processes, and/or as a result of handling or transporting the blank 20 from one point to another. In one embodiment, the system 100 can act upon a blank 20 to impart a desired configuration or profile thereto, independent of any curl bias or other deformation.

In one embodiment, the blank 20 can fit more consistently in a forming tool or forming apparatus downstream from the system 100 after the curl bias is reduced or eliminated and/or when the blank 20 is provided in a flat or planar configuration. The blanks 20 can move through the system 100 from an upstream end 103 to a downstream end 105 thereof generally in a downstream direction or machine direction M that defines/is parallel to a downstream direction with regard to the system 100 and such that the blanks 20 are engaged by various portions and components of the system 100. In this regard, an upstream direction with regard to the system 100 is a direction opposite the machine direction M/downstream direction.

As shown in FIGS. 1A and 1B, the system 100 can include two lanes 107, 107' each having similar or identical features. Each of the lanes 107, 107' can be a part of a respective stream in communication with a respective blank feeder and a respective forming apparatus for forming constructs in parallel streams, as discussed further below. In one embodiment, the lanes 107, 107' can be configured to accommodate blanks 20 having different sizes and/or shapes. For clarity, only one of the lanes 107, 107' is described in detail. The system 100 can include any suitable number of lanes (e.g., one or more lanes) for accommodating any suitable number of streams of constructs in parallel.

As shown in FIG. 1A, each lane 107, 107' of the system 100 can include two spaced guides 111, 113, a belt assembly or pressing apparatus or shaping apparatus 115, and two angle brackets or shaping brackets 117*a*, 117*b* (broadly, respective "first shaping bracket" and "second shaping bracket"). The guides 111, 113 can extend from the upstream end 103 to the downstream end 105. While the system 100 has been illustrated in a generally horizontal and level orientation, it will be understood that the system 100 can be constructed so that the guides 111, 113 extend along and have a downward slope in the machine direction M to support and facilitate the movement of blanks 20 therealong, and as described further herein. Accordingly, the upstream ends of the guides 111, 113 can be positioned at a higher elevation with respect to the downstream ends of the guides 111, 113, and a blank 20 can slide along the guides 111, 113 in the machine direction M due to gravity. In this regard, the guides 111, 113 can be positioned in a sloped orientation such that blanks 20 can move therealong without the aid of a conveyor, belt, chain, or other mover.

Figure 2:
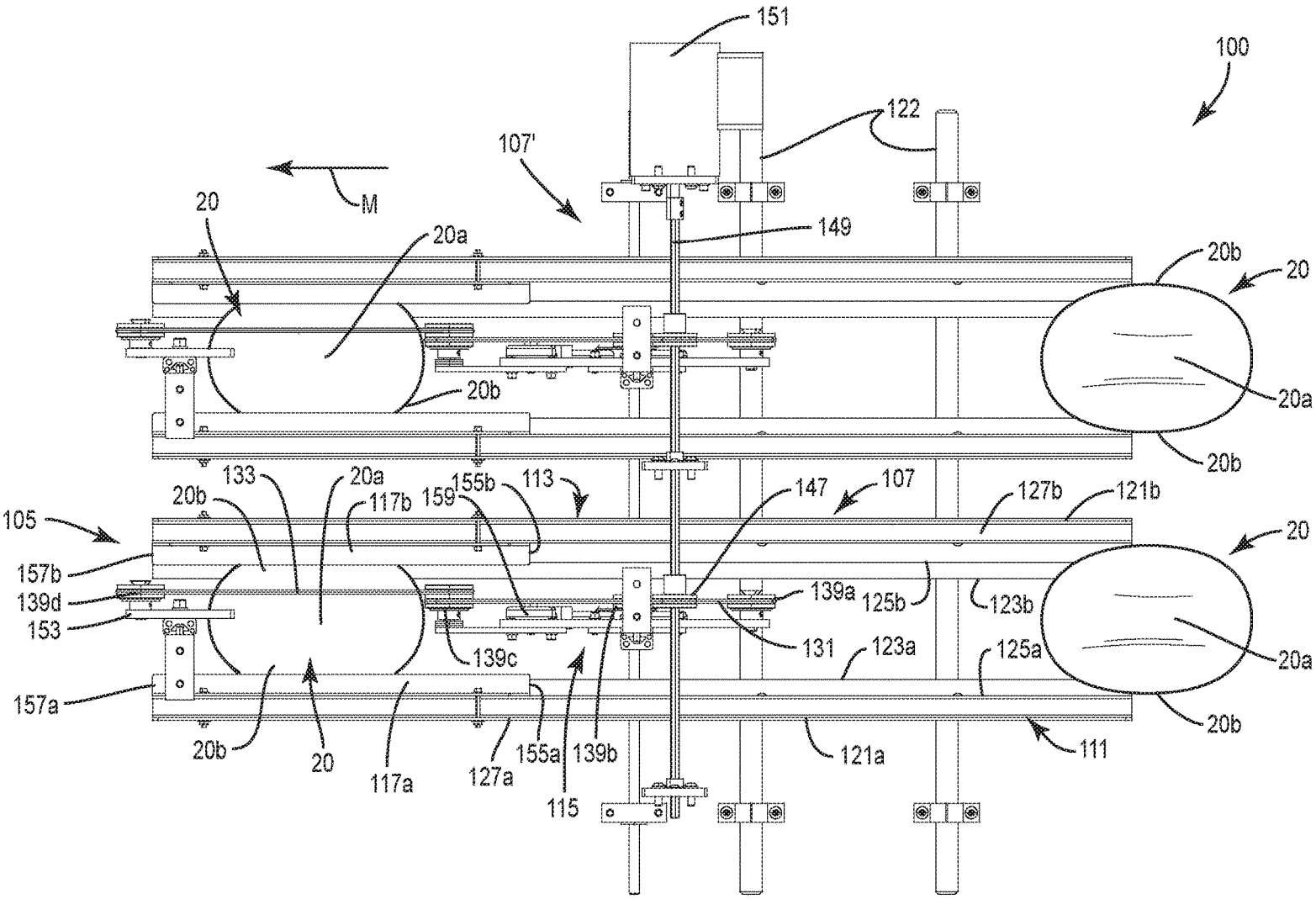
FIG. 2 is a plan view of the system of FIG. 1A.
Figure 3:
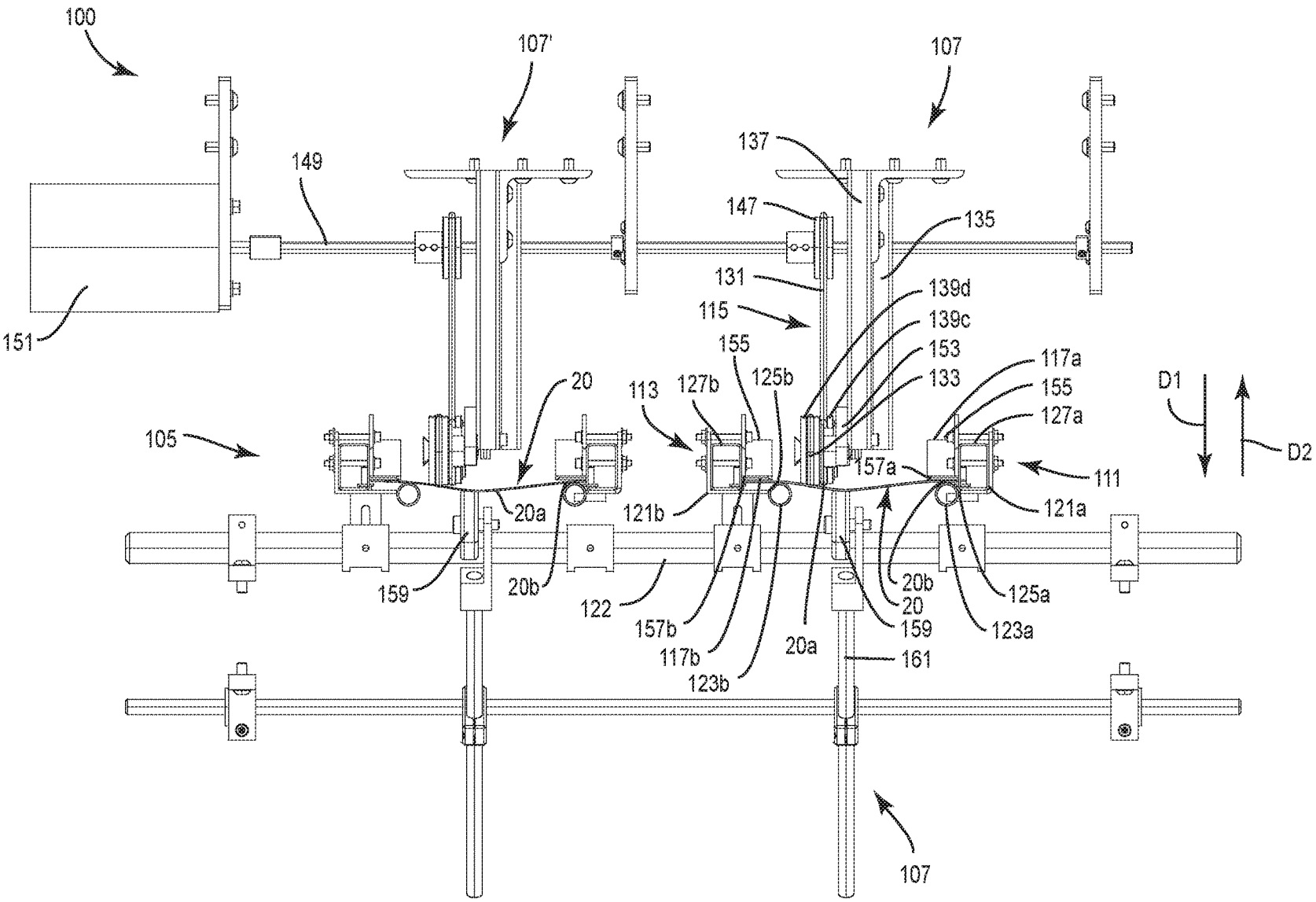
FIG. 3 is a front elevation view of the system of FIG. 1A.

The first guide 111 can include a first main rail or first support rail 121*a*, which can be generally L-shaped and can be mounted to a frame (e.g., via supports 122), and a first rail tube or first blank support 123*a* mounted to the support rail 121*a*. As shown in FIGS. 2 and 3, the blank support 123*a* can be mounted to the support rail 121*a* adjacent and/or abutting an interior edge 125*a* of the support rail 121*a*. Further, as shown in FIG. 3, the blank support 123*a* can have a circular, oval, or otherwise curved cross-section so that the blank support 123*a* has a curved exterior surface for engaging the blank 20 as it slides along the guide 111. In the illustrated embodiment, the blank support 123*a* can extend above the interior edge 125*a* so that the curved side of the blank support 123*a* engages the blank 20. The first guide 111 also can include a spacer 127*a* mounted to the support rail 121*a* as shown in FIGS. 1A-3. As shown, the spacer 127*a* can have a rectangular cross-section.

In the illustrated embodiment, the second guide 113 generally can be a mirror image of the first guide 111 and can include a second main rail or second support rail 121*b*, a second rail tube or second blank support 123*b* mounted to the support rail 121*b* adjacent an interior edge 125*b* of the support rail 121*b*, and a spacer 127*b* mounted to the support rail 121*b*. The guides 111, 113 could be otherwise configured without departing from the disclosure. For example, the blank supports 123*a*, 123*b* could have any suitable shape and/or could be a solid rod instead of a tube or could have an at least partially flattened or angled configuration. In addition, one or both of the spacers 127*a*, 127*b* could have a different shape or could be replaced by a different spacer element. Alternatively, any of the support rails 121*a*, 121*b*, the blank supports 123*a*, 123*b*, the spacers 127*a*, 127*b*, or other elements of the guides 111, 113 could be omitted.

Figure 4A:
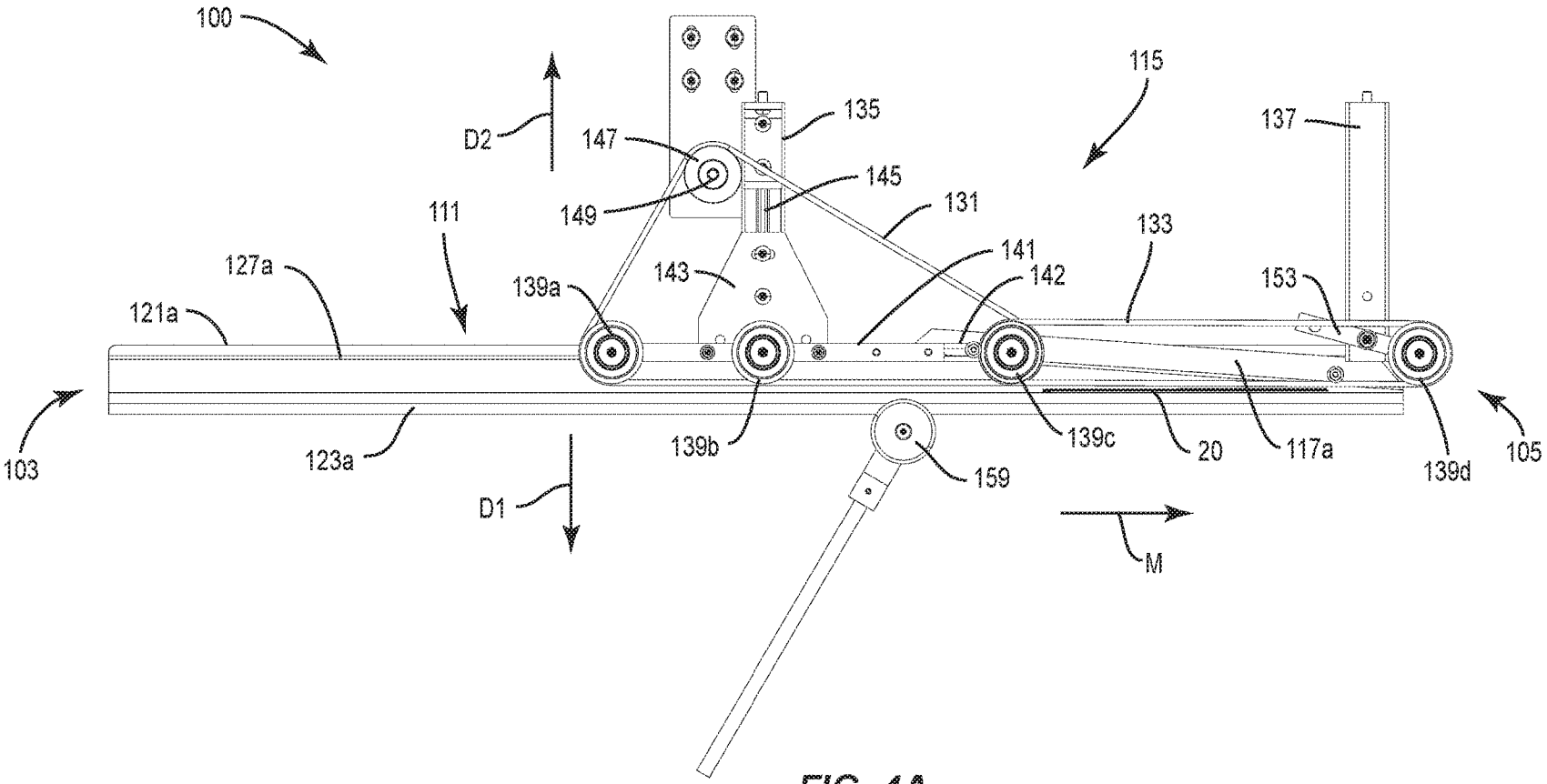
FIG. 4A is a side elevation view of a portion of the system of FIG. 1A.

In the illustrated embodiment, the shaping apparatus 115 can be mounted between the guides 111, 113 and can extend to the downstream end 105 of the system 100. As shown in FIG. 4A, the shaping apparatus 115 can include a first belt 131, a second belt 133, a first support 135, and a second support 137. The first belt 131 can engage three guide pulleys 139*a*, 139*b*, 139*c* (broadly, respective "first pulley", "fourth pulley", and "second pulley") mounted to the first support 135 via pulley mounting bars 141, 142 (broadly, respective "first mounting bar" and "second mounting bar") and a pulley bracket 143. In the illustrated embodiment, the pulleys 139*a*, 139*b* are coupled to the first mounting bar 141 and the pulley 139*c* is coupled to the second mounting bar 142.

In one embodiment, the mounting bars 141, 142 are mounted (e.g., bolted or otherwise coupled with a fastener) together so that the mounting bars 141, 142 are adjustable with respect to one another, such as for moving the guide pulley 139*c* toward or away from the guide pulleys 139*a*, 139*b*, to adjust, e.g., decrease or increase, tension on one or both of the first belt 131 and the second belt 133. In the illustrated embodiment, one or both of the mounting bars 141, 142 can be mounted (e.g., bolted or otherwise coupled with a fastener) to the pulley bracket 143, which is mounted (e.g., bolted or otherwise coupled with a fastener) to the first support 135. In one embodiment, the shaping apparatus 115 can be movably coupled or mounted to the first support 135 such that the shaping apparatus 115 is movable along a direction that is transverse to the downstream direction/machine direction M. For example, the pulley bracket 143 can be mounted to a slot 145 (FIG. 4A) in the first support 135 so that the pulley bracket 143 can be adjusted vertically on the first support 135 in order to adjust the vertical position of the guide pulleys 139*a*, 139*b*, 139*c*. In one embodiment, the first support 135 can be mounted to a frame. As shown in FIGS. 1A-4A, the first belt 131 further can engage a drive pulley 147 of the shaping apparatus 115, which can be mounted on an axel 149 coupled to a motor 151 or other driving member/rotational actuator so as to be in mechanical communication with the motor 151.

As shown in FIG. 1A, the guide pulley 139*c* is a double pulley with two tracks so that the first belt 131 engages one of the tracks and the second belt 133 engages the other track of the guide pulley 139*c*. In the illustrated embodiment, the second belt 133 also engages a downstream guide pulley 139*d* (broadly, "third pulley"), which is mounted to the second support 137 via a downstream mounting bar 153. In one embodiment, the mounting bar 153 can be adjustable to adjust the position of the guide pulley 139*d* for adjusting the height of the second belt 133 and the tension on the second belt 133. In the illustrated embodiment, the motor 151 can drive the axel 149 and the drive pulley 147 to move the first belt 131 over the drive pulley 147 and the guide pulleys 139*a*, 139*b*, 139*c* so that the first belt 131 moves in the machine direction M along the bottoms of the guide pulleys 139*a*, 139*b*, 139*c*. As the first belt 131 moves over the guide pulley 139*c*, it can drive/turn the guide pulley 139*c* to move the second belt 133 over the guide pulleys 139*c*, 139*d* so that the second belt 133 moves in the machine direction M along the bottoms of the guide pulleys 139*c*, 139*d*.

The shaping apparatus 115 could be otherwise configured without departing from the disclosure. For example, the shaping apparatus 115 could include any suitable number of belts and pulleys and/or one or more of the guide pulleys could be driven (e.g., by a motor or actuator).

Figure 4B:
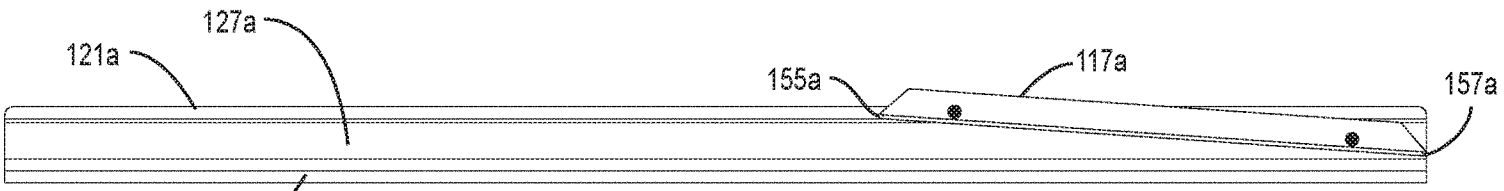
FIG. 4B is another side elevation view of a portion of the system of FIG. 1A.

As shown in FIG. 1A-4B, the first shaping bracket 117*a* is mounted to the first guide 111 (e.g., by bolts/fasteners, adhesive, and/or welding) extending to the downstream end 105 of the system 100. In the illustrated embodiment, the first shaping bracket 117*a* is mounted at an angle with respect to the blank support 123*a*, e.g., oblique to the downstream direction/machine direction M, so that an upstream end 155*a* of the first shaping bracket 117*a* is spaced farther apart from the blank support 123*a* than a downstream end 157*a* of the first shaping bracket 117*a* is spaced from the blank support 123*a* (FIG. 4B). In one embodiment, the first shaping bracket 117*a* has a generally L-shaped cross-section so that one side is mounted to the guide 111 and the other side extends inwardly from the guide 111 over the blank support 123*a*. In the illustrated embodiment, the second shaping bracket 117*b* generally is a mirror image of the first shaping bracket 117*a* and is mounted (e.g., bolted/fastened, adhered, and/or welded) to the second guide 113. The first shaping bracket 117*a* and/or the second shaping bracket 117*b* could be omitted or could be otherwise configured without departing from the disclosure.

As shown in FIGS. 3 and 4A, the system 100 can further include a guide wheel 159 positioned under the guides 111, 113 for engaging or supporting a lower surface of the blanks 20 when they are engaged by the belts 131, 133 as described in more detail below. The guide wheel 159 can be mounted on a support 161. The guide wheel 159 could be omitted or could be otherwise configured without departing from the disclosure. For example, the system 100 could include any suitable number of guide wheels or the guide wheel 159 could be replaced by a conveyor.

In the illustrated embodiment, the system 100 can have directions D1, D2 as indicated by the arrows in FIGS. 3 and 4A. The direction D1 can be generally perpendicular to the machine direction M and to the plane extending from the first guide 111 to the second guide 113 and the direction D2 can be generally perpendicular to the machine direction M and opposite to the direction D1 in the same plane as the direction D1. In one embodiment, the blanks 20 can have an undesirable curl bias wherein the interior region 20*a* of the blank 20 can tend to bend or curve in the direction D2 with respect to the plane extending from the first guide 111 to the second guide 113. The system 100 can press an interior region 20*a* of the blanks 20 in the direction D1 to help overcome the undesirable curl bias (e.g., generally flattening the blanks 20). In one embodiment, the system 100 can press on the interior region 20*a* of a generally flat blank 20 to introduce a desirable curl bias or curvature to the blanks prior to press-forming the blanks into the constructs.

In operation, and as shown in FIGS. 1A-2, a blank 20 having the first, curved or curled configuration can be placed between the guides 111, 113 on the blank supports 123*a*, 123*b* at the upstream end 103 of the system 100. The blank 20 can slide generally downwardly along the outer surfaces of the blank supports 123*a*, 123*b* in the machine direction M (e.g., due to gravity). While the shaping apparatus 115 is configured with the belts 131, 133 spaced from the blank 20 as shown in FIGS. 3 and 4A, the shaping apparatus 115 can be adjusted to move one or more of the guide wheels 139*a*, 139*b*, 139*c*, 139*d* in the direction D1 so that the belts 131, 133 engage the upper surface of the blank 20 to press the interior 20*a* of the blank in the direction D1 as the blank moves along the blank supports 123*a*, 123*b* under the shaping apparatus 115. In one embodiment, the belts 131, 133 can move over the guide pulleys 139*a*, 139*b*, 139*c*, 139*d* due to the rotation of the drive pulley 147 by the motor 151 at a rate so that the portions of the belts 131, 133 that engage the blanks 20 are moving in the machine direction M at a similar speed to the blanks 20 when they engage the shaping apparatus 115. Alternatively, the belts 131, 133 could move at any suitable rate (e.g., to speed up or slow down the blanks 20 as they move in the machine direction M along the guides 111, 113).

In one embodiment, when the belts 131, 133 and/or pulleys 139*a*, 139*b*, 139*c*, 139*d* push against the upper surface of the blank 20, the blank 20 can bend so that the interior region 20*a* of the blank 20 bends in the direction D1 and at least a portion of the peripheral region 20*b* of the blanks 20 bends in the direction D2 with respect to the interior region 20*a* of the blank.

As the blanks 20 that are bent/curved under the action of the belts 131, 133 and/or pulleys 139*a*, 139*b*, 139*c*, 139*d* continue to move in the downstream direction/machine direction M, they slide along the curved outer surfaces of the blank supports 123*a*, 123*b* (e.g., so that the blanks 20 do not slide against a corner or sharp edge thereof). As the blanks 20 move past the shaping brackets 117*a*, 117*b*, the portions of the peripheral region 20*b* of the blanks 20 that are bent in the direction D2 due to the pressing on the blanks 20 by the belts 131, 133 can engage an undersurface of the respective shaping brackets 117*a*, 117*b*, as shown in FIG. 5B. In the illustrated embodiment, the undersurfaces of the shaping brackets 117*a*, 117*b* are sloped so that portions of the peripheral region 20*b* of the blanks 20 are increasingly pressed against/pressed by or otherwise engaged by the shaping brackets 117*a*, 117*b* of the blanks 20 in the direction D1 toward the blank supports 123*a*, 123*b* as the blanks 20 move in the machine direction M and toward the downstream ends 157*a*, 157*b* of the respective shaping brackets 117*a*, 117*b*. The engagement of the belts 131, 133 and/or pulleys 139*a*, 139*b*, 139*c*, 139*d* and the shaping brackets 117*a*, 117*b* with the blank 20 causes a reconfiguration of the blank 20 from the first, curved or curled configuration, to the second, generally planar or generally flat configuration illustrated toward the downstream end 105 of the system 100 as illustrated in FIGS. 1A-2.

Referring additionally to FIG. 5A, in one embodiment, the system 100 can be incorporated into a method and forming system 200 for forming blanks 20 into constructs 21. As shown in FIG. 5A, the system 200 can include a blank feeder 201 at an upstream end 203 of the system 200, the system 100 and shaping apparatus 115 downstream from the blank feeder 201, and a press-forming apparatus 207 positioned downstream from the system 100 and shaping apparatus 115 and that press-forms the blanks 20 into constructs 21 and outputs the constructs 21 at a downstream end 205 of the system 200. As also shown, the blank feeder 201 and the press-forming apparatus 207 are in communication with the system 100 such that blanks 20 can be moved from the blank feeder 201, through the system 100, and into the press-forming apparatus 207.

The blank feeder 201 can be a pick-and-place-style blank feeder with a vacuum cup 211 mounted on a respective actuator arm 213 associated with each lane 107, 107' of the system 100. The blank feeder 201 can include a hopper 215 holding one or more stacks 217 of the blanks 20. The actuator arms 213 can be arranged to position the vacuum cups 211 to engage a blank 20 in the respective stack 217 and a vacuum can be applied to the vacuum cups 211 (e.g., via a hose 219) so that the vacuum cups 211 acquire the blanks 20 through suction. In one embodiment, the actuator arms 213 can be mounted to a support member 214, and can be independently or together driven (e.g., driven by a motor, a pneumatic actuator, or other suitable actuator).

Subsequently, and as shown in FIG. 5C, the actuator arm 213 can rotate to move the blank 20 from the stacks 217 to the guides 111, 113 at the upstream end 103 of the system 100 (FIG. 6B). Thereafter, the vacuum cups 211 can release the blanks 20 onto the guides 111, 113 (e.g., by reversing the vacuum pressure) and the actuator arm 213 can return the vacuum cups 211 to the stacks 217 to acquire another blank 20 (e.g., to the position shown in FIG. 5A).

The blank feeder 201 could be otherwise configured without departing from the disclosure. For example, the blank feeder 201 could include any suitable number of vacuum cups 211 and/or the vacuum cup 211 could be any other suitable actuator for holding a blank 20 and moving the blank from the stack 217 to the system 100. Alternatively, the blank feeder 201 could comprise other types of feeders such as mechanisms that convey blanks 20 directed from a blank cutting station, or any other suitable types of feeders or other mechanisms without departing from the disclosure.

Once the blank feeder 201 releases and/or positions the blank 20 onto the guides 111, 113, the blank 20 can slide along the guides 111, 113 (e.g., along the blank supports 123*a*, 123*b*) to the downstream end 105 of the system 100 and, ultimately, to the press-forming apparatus 207. As the blank 20 moves along guides 111, 113 of the system 100 in the downstream direction, the blank 20 engages the belts 131, 133 and the shaping brackets 117*a*, 117*b*, which can press the blank 20 as described herein.

As shown in FIGS. 5A and 5B, the belts 131, 133 of the system 100 can press on the interior region 20*a* of the blank 20 in the direction D1 (e.g., transverse to the downstream direction/machine direction M) as the blank 20 moves in the machine direction M. The deflection of the interior region 20*a* of the blank 20 in the direction D1 can cause opposed portions of the peripheral region 20*b* of the blank 20 to be displaced in the direction D2 so that respective portions of the peripheral region 20*b* are engaged by the undersurface of the shaping brackets 117*a*, 117*b* as the blank 20 continues to slide along the guides 111, 113 in the machine direction M.

As the blank 20 continues toward the downstream end 105 of the system 100, the shaping brackets 117*a*, 117*b* converge downwardly to the respective blank supports 123*a*, 123*b* to gradually engage/press the respective portions of the outer portion 20*b* of the blank 20. Subsequently, the blank 20 can exit the system 100 at its downstream end 105 so that the belt 133 and the shaping brackets 117*a*, 117*b* are free from engagement with the blank 20. In one embodiment, since the blank 20 was pressed by the system 100 generally opposite to its undesirable curl bias, the blank 20 can be flat or flatter than before it moved through the system 100.

The blank 20 can slide from the downstream end 105 of the system 100 onto a first tool part 221 of the press-forming apparatus 207. As shown in FIGS. 5C and 5D, the first tool part 221 can cooperate with a second tool part 223 of the press-forming apparatus 207 to press-form the blank 20 into the construct 21. In the illustrated embodiment, the first tool part 221 is a male forming apparatus part including a forming head 222 or other shaping structure, the second tool part 223 is a female forming apparatus part including a cavity or other recess (not shown) for at least partially receiving the forming head 222, and the second tool part 223 is actuated to move toward the first tool part 221 (e.g., by a motor, a hydraulic or pneumatic actuator, or other suitable actuator) after the blank 20 is located onto the first tool part 221. The press-forming apparatus 207 could be otherwise configured without departing from the disclosure. For example, the male forming part could be disposed above the female forming part and/or either or both of the tool parts 221, 223 could be configured to move toward the other. Any suitable forming apparatus could be used with the system 100 to form any suitable size and shape blank into any suitable construct without departing from the disclosure.

In one embodiment, after the construct 21 is formed by press-forming the blank 20 with the press-forming apparatus 207, the construct 21 can be ejected from the press-forming apparatus 207 to output guides 225, 226 at the downstream end 205 of the system 200. In the illustrated embodiment, the constructs 21 can be stacked for storage and/or transport. Alternatively, the constructs 21 could be output from the forming system 200 onto a conveyor for further processing.

In one embodiment, the system 100 can help the blanks 20 fit in the press-forming apparatus 207 more consistently and predictably, which can help reduce variance in the constructs 21 formed in the press-forming apparatus 207.

In one embodiment, the blanks 20 can be formed from a web of material by a laminating and/or die cutting system (not shown) that moves the web of material over different cylindrical rollers (e.g., for applying glue, for applying laminated materials such as films and/or microwave energy interactive materials, for cutting the blanks from the web, etc.) that can apply a certain curl bias to the blanks 20.

In certain embodiments, the laminating and/or die cutting system can be configured to apply a pre-determined curl bias to the blanks, which can be beneficial for loading the blanks into the blank feeder 201 and can help the vacuum cup 211 acquire the blanks 20.

However, the curl bias may not be consistently applied by a laminating and/or die cutting system such that an operator loading the blanks into the blank feeder 201 might bend the blanks in an effort to correct the curl bias or to achieve a more desirable curl bias. However, different operators may apply different curl biases to the blanks or an operator may inconsistently apply bending forces to the blanks. In this regard, the system 100 is positioned between the blank feeder 201 and the press-forming apparatus 207 to reduce, eliminate, and/or correct the curl bias applied to the blanks 20 such that the blanks 20 exiting the system 100 are provided in a consistent and predictable configuration (e.g., a generally flat or planar configuration or a configuration in which a desired curl bias is provided). In one embodiment, processing or shaping can refer to reducing or eliminating a curl bias or other deformation on a blank. Alternatively, shaping can refer to the application of a particular curl-bias on a blank.

In this regard, the forming system 200 that includes the system 100 described herein is advantageous as compared to, for example, a forming system that lacks such a system, in which blanks having different curl biases (or which lack a desired curl bias) can be provided to a forming apparatus such that different blanks have a different fits in the press-forming apparatus 207, which can lead to a different fit in the press-forming apparatus 207 for different blanks, e.g., such that off-center or misaligned placements with regard to the press-forming apparatus 207 can result and such that undesirable or inconsistent product defects can form, e.g., inconsistent flange formations on the constructs.

In general, the blanks of the present disclosure may be constructed from paperboard having a caliper so that it is heavier and more rigid than ordinary paper. The blank can also be constructed of other materials, such as cardboard, or any other material having properties suitable for enabling the construct to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A method of processing a blank for forming a construct, the method comprising:

obtaining the blank, the blank comprising a flexible material and is for being formed into a construct;

moving the blank in a downstream direction on a first guide and a second guide; and pressing an interior region of the blank with a shaping apparatus in a first direction transverse to the downstream direction as the blank moves in the downstream direction to cause the peripheral region of the blank to move in a second direction transverse to the downstream direction into engagement with at least one shaping bracket, the first direction is opposite the second direction, the at least one shaping bracket extending at least partially away from the first guide and the second guide in the first direction.

2. The method of claim 1, wherein the blank comprises paperboard.

3. The method of claim 2, wherein obtaining the blank comprises obtaining the blank in a first, curved configuration, and pressing the interior region of the blank reconfigures the blank from the first configuration to a second, substantially planar configuration.

4. The method of claim 2, wherein the shaping apparatus is movably coupled to a support such that the shaping apparatus is movable along the direction transverse to the downstream direction.

5. The method of claim 4, wherein the shaping apparatus comprises a plurality of pulleys engaged with a plurality of belts.

6. The method of claim 5, wherein the plurality of pulleys comprises a first pulley, a second pulley, and a third pulley.

7. The method of claim 6, wherein the plurality of belts comprises a first belt engaged with the first pulley and the second pulley, and a second belt engaged with the second pulley and the third pulley.

8. The method of claim 7, wherein the first pulley is coupled to a first mounting bar and the second pulley is coupled to a second mounting bar, the first mounting bar and the second mounting bar are adjustable relative to one another to adjust tension in at least one of the first belt and the second belt.

9. The method of claim 7, wherein the plurality of pulleys further comprises a drive pulley in mechanical communication with a motor and engaged with the first belt, and a fourth pulley engaged with the first belt.

10. The method of claim 2, wherein the at least one shaping bracket is a first shaping bracket mounted to the first guide and the peripheral region of the blank is further engaged by a second shaping bracket mounted to the second guide.

11. The method of claim 10, wherein the first shaping bracket and the second shaping bracket are mounted at an oblique angle relative to the respective first guide and second guide.

12. The method of claim 10, wherein the first guide comprises a first blank support and the second guide comprises a second blank support, the moving the blank in the downstream direction comprises sliding the blank along the first blank support and the second blank support.

13. The method of claim 12, wherein the first shaping bracket is mounted to converge downward to the first blank support and the second shaping bracket is mounted to converge downward to the second blank support.

14. The method of claim 13, wherein the shaping apparatus comprises a plurality of pulleys engaged with a plurality of belts.

15. The method of claim 2, further comprising moving the blank in the downstream direction from the first guide and the second guide to a forming apparatus.

16. The method of claim 15, further comprising pressing the blank in the forming apparatus to form the construct.

17. A system for processing a blank comprising a flexible material, the system comprising:

a first guide and a second guide at least partially supporting the blank and extending along a machine direction from an upstream end of the system to a downstream end of the system;

a shaping apparatus coupled to a support, the shaping apparatus is movable along the support in a first direction transverse to the machine direction to press an interior region of the blank; and a shaping bracket mounted to at least one of the first guide and the second guide for engaging a peripheral region of the blank as the blank is pressed by the shaping apparatus, the shaping apparatus is movable along the support in the first direction transverse to the machine direction for pressing the interior region of the blank in the first direction transverse to the machine direction to cause the peripheral region of the blank to move in a second direction transverse to the machine direction into engagement with the shaping bracket, the first direction is opposite the second direction, the shaping bracket extending at least partially away from the first guide and the second guide in the first direction.

18. The system of claim 17, wherein the blank comprises paperboard.

19. The system of claim 18, wherein when the interior region of the blank is pressed, the blank reconfigures from a first, curved configuration to a second, substantially planar configuration.

20. The system of claim 18, wherein the shaping apparatus is movably coupled to the support such that the shaping apparatus is movable along the direction transverse to the machine direction.

21. The system of claim 20, wherein the shaping apparatus comprises a plurality of pulleys engaged with a plurality of belts.

22. The system of claim 21, wherein the plurality of pulleys comprises a first pulley, a second pulley, and a third pulley.

23. The system of claim 22, wherein the plurality of belts comprises a first belt engaged with the first pulley and the second pulley, and a second belt engaged with the second pulley and the third pulley.

24. The system of claim 23, wherein the first pulley is coupled to a first mounting bar and the second pulley is coupled to a second mounting bar, the first mounting bar and the second mounting bar are adjustable relative to one another to adjust tension in at least one of the first belt and the second belt.

25. The system of claim 23, wherein the plurality of pulleys further comprises a drive pulley in mechanical communication with a motor and engaged with the first belt, and a fourth pulley engaged with the first belt.

26. The system of claim 18, wherein the shaping bracket is a first shaping bracket mounted to the first guide and the system further comprises a second shaping bracket mounted to the second guide.

27. The system of claim 26, wherein the first shaping bracket and the second shaping bracket are mounted at an oblique angle relative to the respective first guide and second guide.

28. The system of claim 26, wherein the first guide comprises a first blank support and the second guide comprises a second blank support, the blank is slidable along the first blank support and the second blank support in the machine direction.

29. The system of claim 28, wherein the first shaping bracket is mounted to converge downward to the first blank support and the second shaping bracket is mounted to converge downward to the second blank support.

30. The system of claim 29, wherein the shaping apparatus comprises a plurality of pulleys engaged with a plurality of belts.

31. A forming system for forming a construct from a blank comprising a flexible material, the forming system comprising:

a blank feeder for positioning the blank on a first guide and a second guide, the first guide and the second guide extending in a downstream direction;

a shaping apparatus downstream from the blank feeder and coupled to a support, the shaping apparatus is movable along the support in a first direction transverse to the downstream direction for pressing an interior region of the blank;

a shaping bracket mounted to at least one of the first guide and the second guide for engaging a peripheral region of the blank as the blank is pressed by the shaping apparatus; and a press-forming apparatus positioned downstream from the shaping apparatus and being for forming the construct from the blank, the shaping apparatus is movable along the support in the first direction transverse to the downstream direction for pressing the interior region of the blank in the first direction transverse to the downstream direction to cause the peripheral region of the blank to move in a second direction transverse to the downstream direction into engagement with the shaping bracket, the first direction is opposite the second direction, the shaping bracket extends at least partially away from the first guide and the second guide in the first direction.

32. The forming system of claim 31, wherein the blank comprises paperboard.

33. The forming system of claim 32, wherein when the interior region of the blank is pressed, the blank reconfigures from a first, curved configuration to a second, substantially planar configuration.

34. The forming system of claim 32, wherein the shaping apparatus is movably coupled to the support such that the shaping apparatus is movable along the direction transverse to the downstream direction.

35. The forming system of claim 34, wherein the shaping apparatus comprises a plurality of pulleys engaged with a plurality of belts.

36. The forming system of claim 35, wherein the plurality of pulleys comprises a first pulley, a second pulley, and a third pulley.

37. The forming system of claim 36, wherein the plurality of belts comprises a first belt engaged with the first pulley and the second pulley, and a second belt engaged with the second pulley and the third pulley.

38. The forming system of claim 37, wherein the first pulley is coupled to a first mounting bar and the second pulley is coupled to a second mounting bar, the first mounting bar and the second mounting bar are adjustable relative to one another to adjust tension in at least one of the first belt and the second belt.

39. The forming system of claim 37, wherein the plurality of pulleys further comprises a drive pulley in mechanical communication with a motor and engaged with the first belt, and a fourth pulley engaged with the first belt.

40. The forming system of claim 32, wherein the shaping bracket is a first shaping bracket mounted to the first guide and the system further comprises a second shaping bracket mounted to the second guide.

41. The forming system of claim 40, wherein the first shaping bracket and the second shaping bracket are mounted at an oblique angle relative to the respective first guide and second guide.

42. The forming system of claim 40, wherein the first guide comprises a first blank support and the second guide comprises a second blank support, the blank is slidable along the first blank support and the second blank support.

43. The forming system of claim 42, wherein the first shaping bracket is mounted to converge downward to the first blank support and the second shaping bracket is mounted to converge downward to the second blank support.

44. The forming system of claim 43, wherein the shaping apparatus comprises a plurality of pulleys engaged with a plurality of belts.

* * * * *